US009988926B2

(12) United States Patent
Gasmen et al.

(10) Patent No.: US 9,988,926 B2
(45) Date of Patent: Jun. 5, 2018

(54) MACHINED VANE ARM OF A VARIABLE VANE ACTUATION SYSTEM

(71) Applicant: United Technologies Corporation, Hartford, CT (US)

(72) Inventors: Eugene C. Gasmen, Rocky Hill, CT (US); Bernard W. Pudvah, Portland, CT (US); Christopher St. Mary, Hebron, CT (US); Stanley Wiecko, Newington, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 314 days.

(21) Appl. No.: 14/775,042

(22) PCT Filed: Feb. 18, 2014

(86) PCT No.: PCT/US2014/016876
§ 371 (c)(1),
(2) Date: Sep. 11, 2015

(87) PCT Pub. No.: WO2014/158455
PCT Pub. Date: Oct. 2, 2014

(65) Prior Publication Data

US 2016/0032759 A1 Feb. 4, 2016

Related U.S. Application Data

(60) Provisional application No. 61/836,702, filed on Jun. 19, 2013, provisional application No. 61/778,856, filed on Mar. 13, 2013.

(51) Int. Cl.
*F01D 17/14* (2006.01)
*F01D 9/04* (2006.01)
(Continued)

(52) U.S. Cl.
CPC ..... *F01D 17/14* (2013.01); *F01D 9/041* (2013.01); *F01D 17/162* (2013.01);
(Continued)

(58) Field of Classification Search
CPC ..... F01D 17/16; F01D 17/162; F04D 29/563; F05D 2260/50
See application file for complete search history.

(56) References Cited

U.S. PATENT DOCUMENTS 4,979,874 A 12/1990 Myers
5,024,580 A 6/1991 Olive
(Continued)

FOREIGN PATENT DOCUMENTS

FR 2897120 8/2007
WO 2015026420 2/2015

OTHER PUBLICATIONS

Supplementary European Search Report for Application No. 14773280.4 dated Oct. 13, 2016.
(Continued)

*Primary Examiner* — Woody Lee, Jr.
*Assistant Examiner* — Brian O Peters
(74) *Attorney, Agent, or Firm* — Carlson, Gaskey & Olds, P.C.

(57) ABSTRACT

An exemplary variable vane actuation system includes, among other things, a vane arm with a vane stem contact surface and a radially outward facing surface. The vane stem contact surface is to contact a vane stem of a variable vane and thereby actuate the variable vane about a radially extending axis. The vane stem contact surface is angled relative to both the radially extending axis and the radially outward facing surface.

18 Claims, 6 Drawing Sheets

(51) Int. Cl.
*F04D 29/56* (2006.01)
*F01D 17/16* (2006.01)

(52) U.S. Cl.
CPC ..... *F04D 29/563* (2013.01); *F05D 2220/32* (2013.01); *F05D 2230/10* (2013.01); *F05D 2240/12* (2013.01); *F05D 2260/36* (2013.01); *F05D 2260/50* (2013.01)

(56) References Cited

U.S. PATENT DOCUMENTS

| | | | | |
|---|---|---|---|---|
| 5,492,446 | A | 2/1996 | Hawkins et al. | |
| 6,019,574 | A | 2/2000 | DiBella | |
| 7,011,494 | B2 | 3/2006 | Kies et al. | |
| 7,344,355 | B2 * | 3/2008 | Wilshaw | F01D 17/162 415/160 |
| 7,448,848 | B2 | 11/2008 | Alexander et al. | |
| 8,651,803 | B2 * | 2/2014 | Jones | F01D 17/162 415/160 |
| 9,228,438 | B2 * | 1/2016 | Dube | F01D 17/162 |
| 2003/0143067 | A1 | 7/2003 | Bouru | |
| 2004/0240990 | A1 | 12/2004 | Rockley | |
| 2005/0232758 | A1 | 10/2005 | Wilshaw | |
| 2010/0068049 | A1 * | 3/2010 | Thermos | F01D 17/162 415/209.3 |
| 2010/0092278 | A1 * | 4/2010 | Major | F01D 17/162 415/160 |
| 2010/0166540 | A1 | 7/2010 | Perez et al. | |
| 2011/0058932 | A1 | 3/2011 | Jones et al. | |
| 2012/0251297 | A1 | 10/2012 | Major et al. | |

OTHER PUBLICATIONS

International Preliminary Report on Patentability for PCT Application No. PCT/US2014/016876, dated Sep. 24, 2015.

International Search Report and Written Opinion for International Application No. PCT/US2014/016876 dated Jun. 2, 2014.

* cited by examiner

MACHINED VANE ARM OF A VARIABLE VANE ACTUATION SYSTEM

BACKGROUND

This disclosure relates to relatively high-strength vane arms for a variable vane actuation system of a gas turbine engine.

A gas turbine engine typically includes a fan section, a compressor section, a combustor section and a turbine section. Air entering the compressor section is compressed and delivered into the combustion section where it is mixed with fuel and ignited to generate a high-speed exhaust gas flow. The high-speed exhaust gas flow expands through the turbine section to drive the compressor and the fan section. The compressor section typically includes low and high pressure compressors, and the turbine section includes low and high pressure turbines.

Vanes are provided between rotating blades in the compressor and turbine sections. Moreover, vanes are also provided in the fan section. In some instances the vanes are movable to tailor flows to engine operating conditions. Variable vanes are mounted about a pivot and are attached to an arm that is in turn actuated to adjust each of the vanes of a stage. A specific orientation between the arm and vane is required to assure that each vane in a stage is adjusted as desired to provide the desired engine operation. Accordingly, the connection of the vane arm to the actuator and to the vane is provided with features that assure a proper connection and orientation.

SUMMARY

A variable vane actuation system according to an exemplary aspect of the present disclosure includes, among other things, a vane arm with at least one vane stem contact surface and a radially outward facing surface, the at least one vane stem contact surface to contact a vane stem of a variable vane and thereby actuate the variable vane about a radially extending axis, the at least one vane stem contact surface angled relative to both the radially extending axis and the radially outward facing surface.

In a further non-limiting embodiment of the foregoing variable vane actuation system, the system may include an aperture extending through the radially outward facing surface to receive the vane stem, a least a portion of the aperture having a non-circular cross-sectional profile.

In a further non-limiting embodiment of any of the foregoing variable vane actuation systems, the aperture comprises a first axial section and a second axial section, the first axial section having a generally oval-shaped cross sectional profile, the second axial section having a generally circular-shaped cross-sectional profile.

In a further non-limiting embodiment of any of the foregoing variable vane actuation systems, the at least one vane stem contact surface comprises a first vane stem contact surface and a second vane stem contact surface, the aperture positioned between the first and second vane stem contact surfaces.

In a further non-limiting embodiment of any of the foregoing variable vane actuation systems, the at least one vane stem contact surface is a machined surface.

In a further non-limiting embodiment of any of the foregoing variable vane actuation systems, the at least one vane stem contact surface is a milled surface.

In a further non-limiting embodiment of any of the foregoing variable vane actuation systems, the vane arm is continuous radially between the at least one vane stem contact surface and the radially outward facing surface.

In a further non-limiting embodiment of any of the foregoing variable vane actuation systems, the vane arm completely fills an area extending radially from the at least one vane stem contact surface to the radially outward facing surface.

In a further non-limiting embodiment of any of the foregoing variable vane actuation systems, the system includes at least one first radially inward facing surface and at least one second radially inward facing surface, the vane stem contact surface connects the at least one first radially inward facing surface and the at least one second radially inward facing surface.

In a further non-limiting embodiment of any of the foregoing variable vane actuation systems, the first and second radially inward facing surfaces are radially stepped from each other.

In a further non-limiting embodiment of any of the foregoing variable vane actuation systems, the vane arm is configured to be received radially over the vane stem.

A variable vane actuation system for a gas turbine engine according to an another exemplary aspect of the present disclosure includes, among other things, a variable vane assembly including a vane arm attached to a vane stem and arranged to rotate the vane stem about a radial axis, the vane arm having a machined surface to contact and rotate the vane stem.

In a further non-limiting embodiment of the foregoing variable vane actuation system, the vane arm includes a D-shaped opening corresponding with a D-shaped portion of the vane stem.

A vane arm manufacturing method according to yet another exemplary aspect of the present disclosure includes, among other things, machining at least one vane stem contact surface into a piece of material when providing a vane arm, the vane stem contact surface to contact a vane stem to actuate a variable vane. An area that extends radially from the at least one vane stem contact surface to an outwardly facing surface of the vane arm is completely filled with a material.

In a further non-limiting embodiment of the foregoing method, the method may include establishing an aperture in the vane arm, a least a portion of the aperture having a non-circular cross-sectional profile.

In a further non-limiting embodiment of any of the foregoing methods, the method may include the aperture comprises a first axial section and a second axial section, the first axial section having a generally oval-shaped cross sectional profile, the second axial section having a generally circular-shaped cross-sectional profile.

In a further non-limiting embodiment of the foregoing method, the at least one vane stem contact surface comprises a first vane stem contact surface and a second vane stem contact surface, the aperture positioned between the first and second vane stem contact surfaces.

In a further non-limiting embodiment of the foregoing method, the vane arm contact surface is angled relative to both the radially extending axis and the radially outward facing surface.

DETAILED DESCRIPTION

Figure 1:
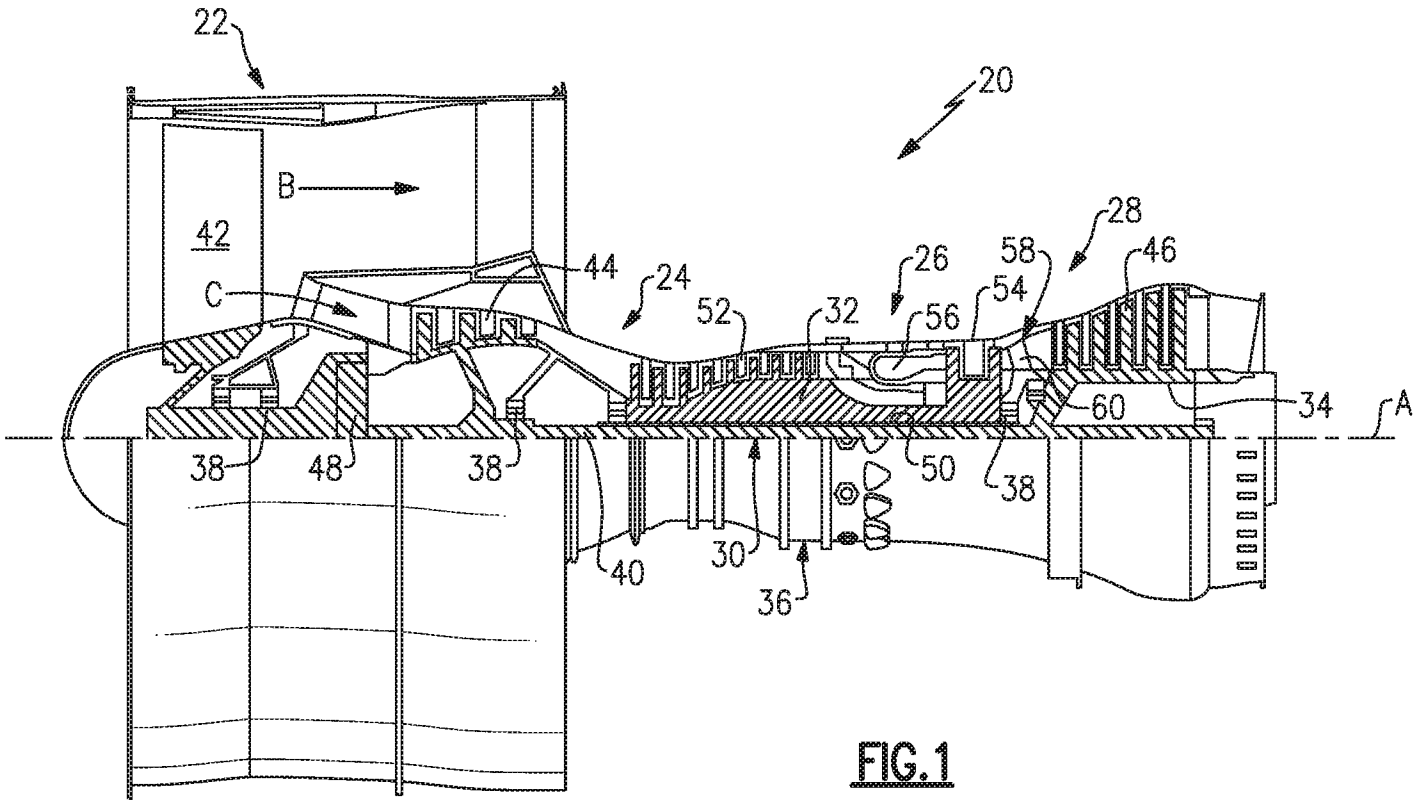
FIG. 1 schematically illustrates an example gas turbine engine.

FIG. 1 schematically illustrates an example gas turbine engine 20 that includes a fan section 22, a compressor section 24, a combustor section 26, and a turbine section 28. Alternative engines might include an augmenter section (not shown) among other systems or features. The fan section 22 drives air along a bypass flow path B while the compressor section 24 draws air in along a core flow path C where air is compressed and communicated to a combustor section 26. In the combustor section 26, air is mixed with fuel and ignited to generate a high pressure exhaust gas stream that expands through the turbine section 28 where energy is extracted and utilized to drive the fan section 22 and the compressor section 24.

Although the disclosed non-limiting embodiment depicts a turbofan gas turbine engine, it should be understood that the concepts described herein are not limited to use with turbofans as the teachings may be applied to other types of turbine engines; for example a turbine engine including a three-spool architecture in which three spools concentrically rotate about a common axis and where a low spool enables a low pressure turbine to drive a fan via a gearbox, an intermediate spool that enables an intermediate pressure turbine to drive a first compressor of the compressor section, and a high spool that enables a high pressure turbine to drive a high pressure compressor of the compressor section.

The example engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided.

The low speed spool 30 generally includes an inner shaft 40 that connects a fan 42 and a low pressure (or first) compressor section 44 to a low pressure (or first) turbine section 46. The inner shaft 40 drives the fan 42 through a speed change device, such as a geared architecture 48, to drive the fan 42 at a lower speed than the low speed spool 30. The high speed spool 32 includes an outer shaft 50 that interconnects a high pressure (or second) compressor section 52 and a high pressure (or second) turbine section 54. The inner shaft 40 and the outer shaft 50 are concentric and rotate via the bearing systems 38 about the engine central longitudinal axis A.

A combustor 56 is arranged between the high pressure compressor 52 and the high pressure turbine 54. In one example, the high pressure turbine 54 includes at least two stages to provide a double stage high pressure turbine 54. In another example, the high pressure turbine 54 includes only a single stage. As used herein, a "high pressure" compressor or turbine experiences a higher pressure than a corresponding "low pressure" compressor or turbine.

The example low pressure turbine 46 has a pressure ratio that is greater than about 5. The pressure ratio of the example low pressure turbine 46 is measured prior to an inlet of the low pressure turbine 46 as related to the pressure measured at the outlet of the low pressure turbine 46 prior to an exhaust nozzle.

A mid-turbine frame 58 of the engine static structure 36 is arranged generally between the high pressure turbine 54 and the low pressure turbine 46. The mid-turbine frame 58 further supports bearing systems 38 in the turbine section 28 as well as setting airflow entering the low pressure turbine 46.

The core airflow C is compressed by the low pressure compressor 44 then by the high pressure compressor 52 mixed with fuel and ignited in the combustor 56 to produce high speed exhaust gases that are then expanded through the high pressure turbine 54 and low pressure turbine 46. The mid-turbine frame 58 includes vanes 60, which are in the core airflow path and function as an inlet guide vane for the low pressure turbine 46. Utilizing the vane 60 of the mid-turbine frame 58 as the inlet guide vane for low pressure turbine 46 decreases the length of the low pressure turbine 46 without increasing the axial length of the mid-turbine frame 58. Reducing or eliminating the number of vanes in the low pressure turbine 46 shortens the axial length of the turbine section 28. Thus, the compactness of the gas turbine engine 20 is increased and a higher power density may be achieved.

The disclosed gas turbine engine 20 in one example is a high-bypass geared aircraft engine. In a further example, the gas turbine engine 20 includes a bypass ratio greater than about six (6:1), with an example embodiment being greater than about ten (10:1). The example geared architecture 48 is an epicyclical gear train, such as a planetary gear system, star gear system or other known gear system, with a gear reduction ratio of greater than about 2.3.

In one disclosed embodiment, the gas turbine engine 20 includes a bypass ratio greater than about ten (10:1) and the fan diameter is significantly larger than an outer diameter of the low pressure compressor 44. It should be understood, however, that the above parameters are only exemplary of one embodiment of a gas turbine engine including a geared architecture and that the present disclosure is applicable to other gas turbine engines.

A significant amount of thrust is provided by the bypass flow B due to the high bypass ratio. The fan section 22 of the engine 20 is designed for a particular flight condition—typically cruise at about 0.8 Mach and about 35,000 feet. The flight condition of 0.8 Mach and 35,000 ft., with the engine at its best fuel consumption—also known as "bucket cruise Thrust Specific Fuel Consumption ('TSFC')"—is the industry standard parameter of pound-mass (lbm) of fuel per hour being burned divided by pound-force (lbf) of thrust the engine produces at that minimum point.

"Low fan pressure ratio" is the pressure ratio across the fan blade alone, without a Fan Exit Guide Vane ("FEGV") system. The low fan pressure ratio as disclosed herein according to one non-limiting embodiment is less than about 1.50. In another non-limiting embodiment, the low fan pressure ratio is less than about 1.45.

"Low corrected fan tip speed" is the actual fan tip speed in ft/sec divided by an industry standard temperature correction of $[(\text{Tram}\ ^\circ\ \text{R})/(518.7^\circ\ \text{R})]^{0.5}$. The "Low corrected fan tip speed," as disclosed herein according to one non-limiting embodiment, is less than about 1150 ft/second.

The example gas turbine engine includes the fan 42 that comprises in one non-limiting embodiment less than about twenty-six (26) fan blades. In another non-limiting embodiment, the fan section 22 includes less than about twenty (20) fan blades. Moreover, in one disclosed embodiment the low pressure turbine 46 includes no more than about six (6) turbine rotors schematically indicated at 34. In another non-limiting example embodiment, the low pressure turbine 46 includes about three (3) turbine rotors. A ratio between the number of fan blades and the number of low pressure turbine rotors is between about 3.3 and about 8.6. The example low pressure turbine 46 provides the driving power to rotate the fan section 22 and therefore the relationship between the number of turbine rotors 34 in the low pressure turbine 46 and the number of blades in the fan section 22 disclose an example gas turbine engine 20 with increased power transfer efficiency.

Figure 2:
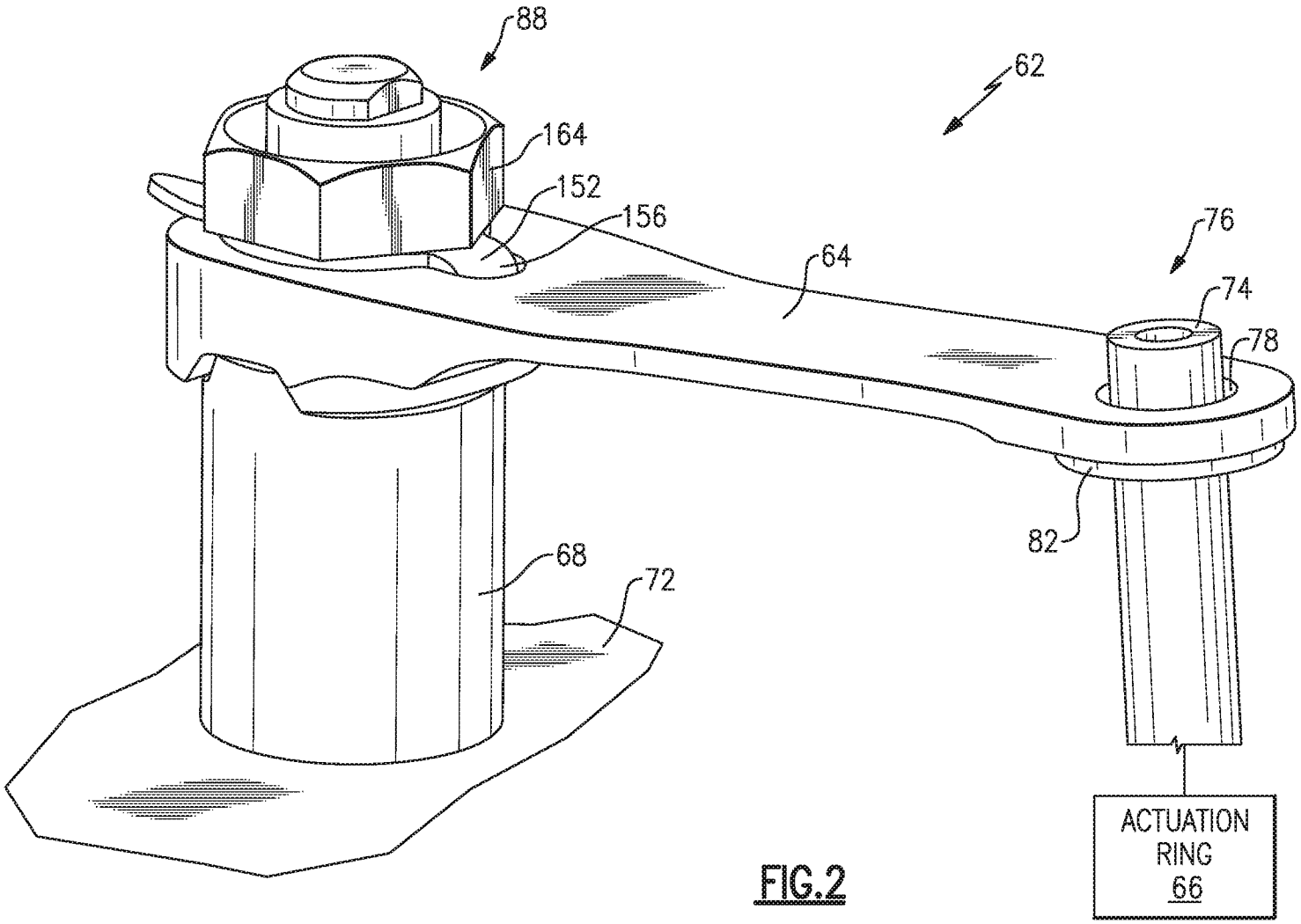
FIG. 2 illustrates a perspective view of a variable vane actuation system used within the engine of FIG. 1.
Figure 3:
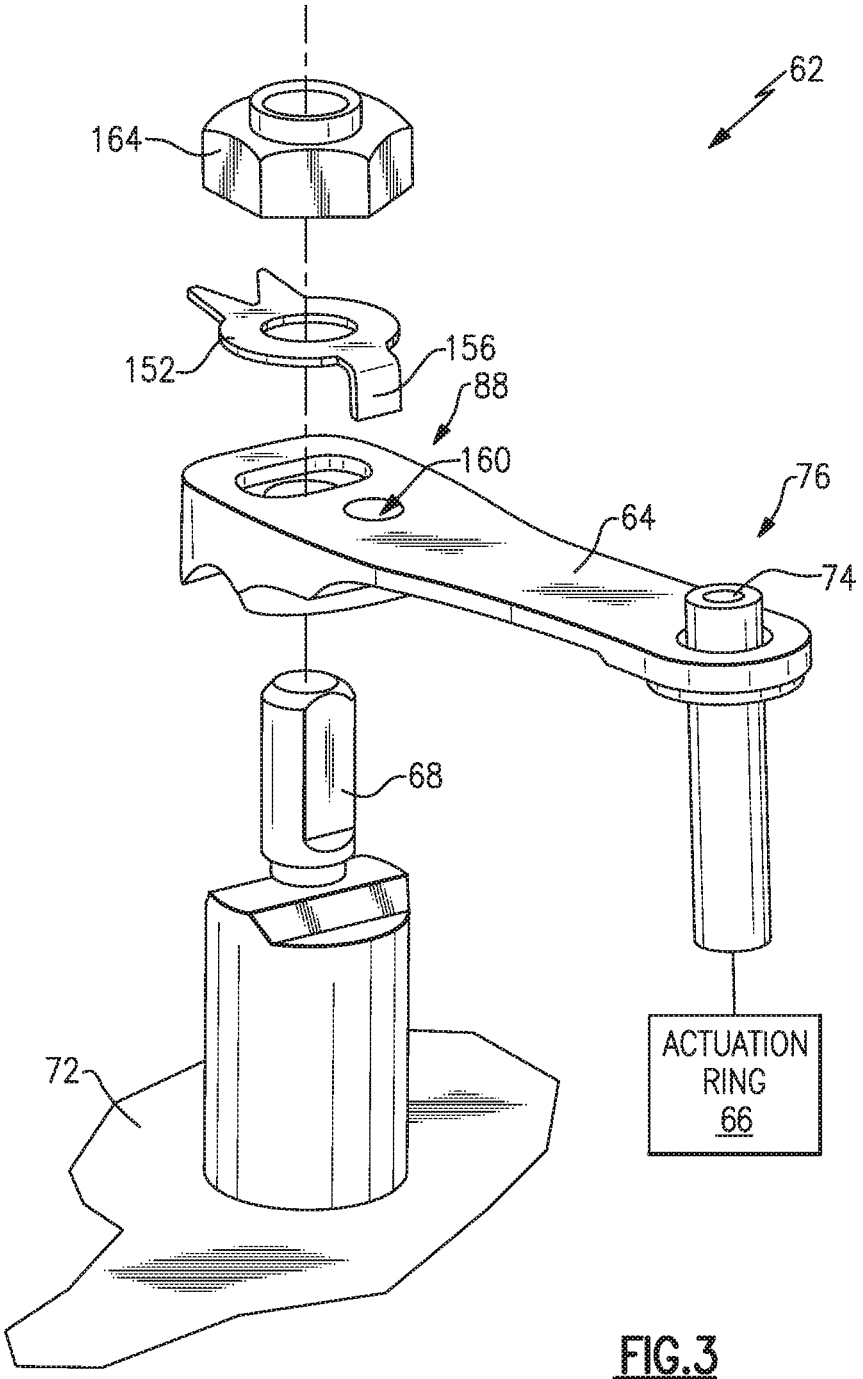
FIG. 3 illustrates an exploded view of the system of FIG. 2.
Figure 4:
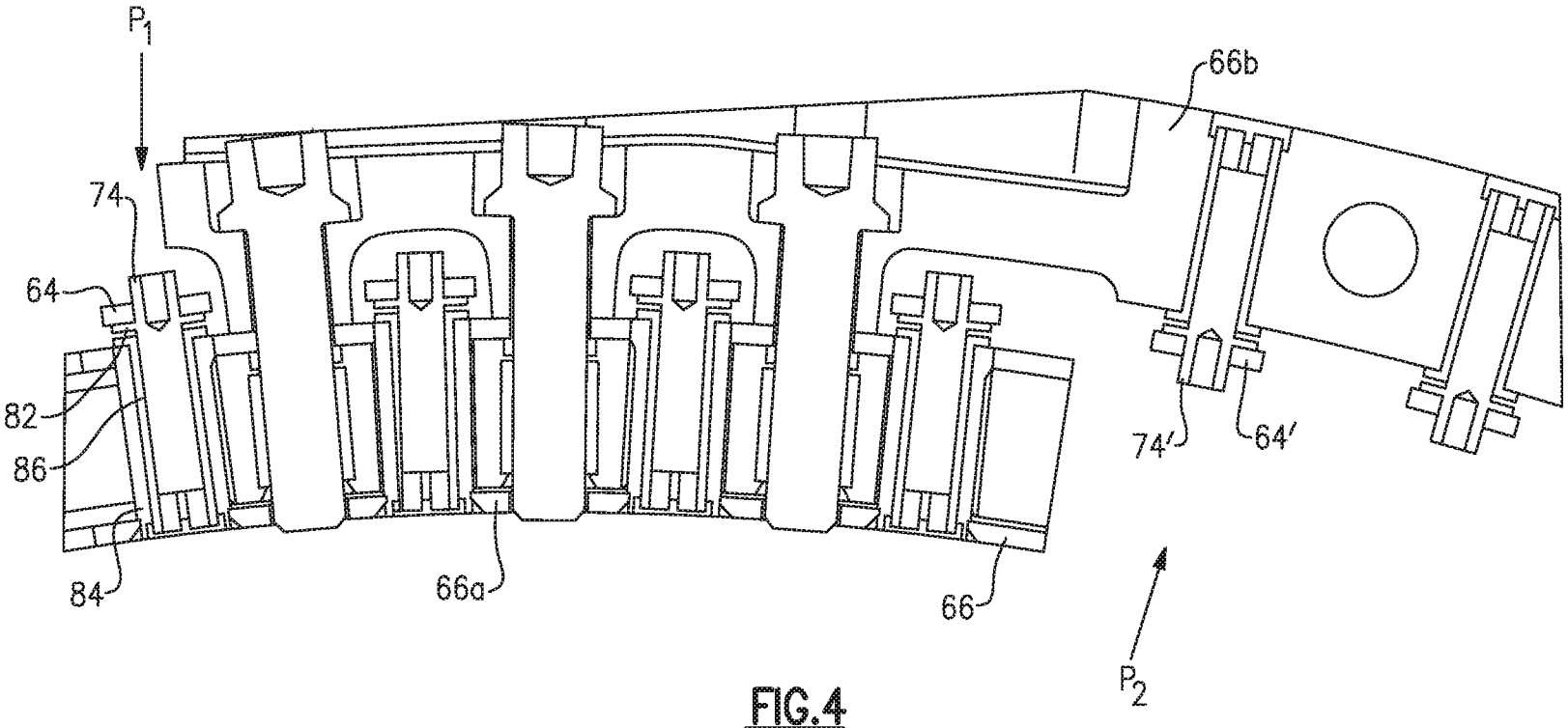
FIG. 4 illustrates an actuation ring used in connection with the system of FIG. 2.

Referring to FIGS. 2-4, an example variable vane actuation system 62 includes a vane arm 64 coupling an actuation ring 66 to a vane stem 68. Rotating the actuation ring 66 circumferentially about the axis A (FIG. 1) moves the vane arm 64 to pivot the vane stem 68, and an associated variable vane 72. The example vane arm 64 is used to manipulate variable guide vanes in the high pressure compressor section 52 of the engine 20 of FIG. 1.

A pin 74 is attached to an end 76 of the vane arm 64. The example pin 74 and vane arm 64 rotate together. In this example, the pin 74 is received within an aperture 78 and then swaged to hold the pin 74 relative to the vane arm 64. A collar 82 of the pin 74 may contact the vane arm 64 during assembly to ensure that the pin 74 is inserted to an appropriate depth prior to swaging.

The pin 74 is radially received within a sync ring bushing 86, which is received within a, typically metal, sleeve 84. The actuation (or sync) ring 66 holds the metal sleeve 84. The bushing 86 permits the pin 74 and the vane arm 64 to rotate together relative to the actuation ring 66 and the metal sleeve 84. The pin 74 and the vane arm 64 are inserted into the bushing 86 by traveling along a radial path $P_1$. Limiting radial movement of the vane arm 64 away from the actuation ring 66 prevents the pin 74 from backing out of the bushing 86 after insertion.

Figure 5:
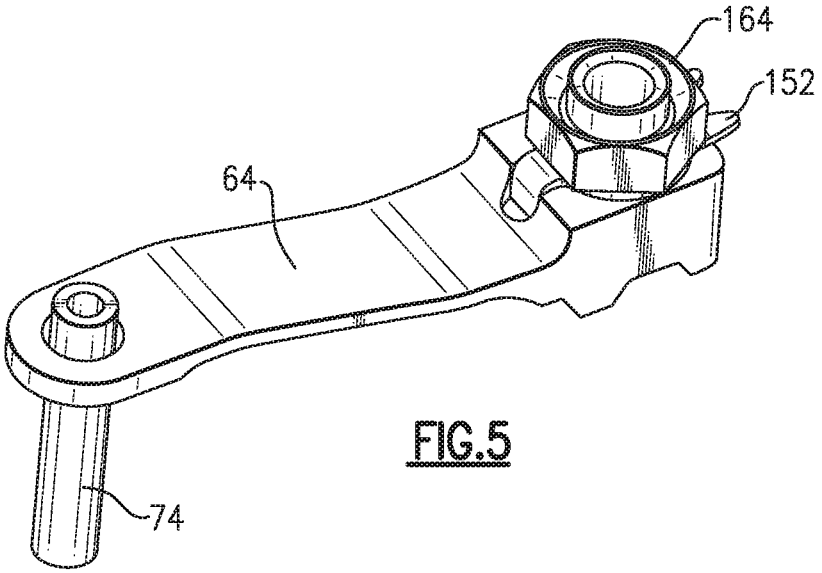
FIG. 5 illustrates an example configuration for attaching the system of FIG. 2 to the actuation ring of FIG. 4.
Figure 6:
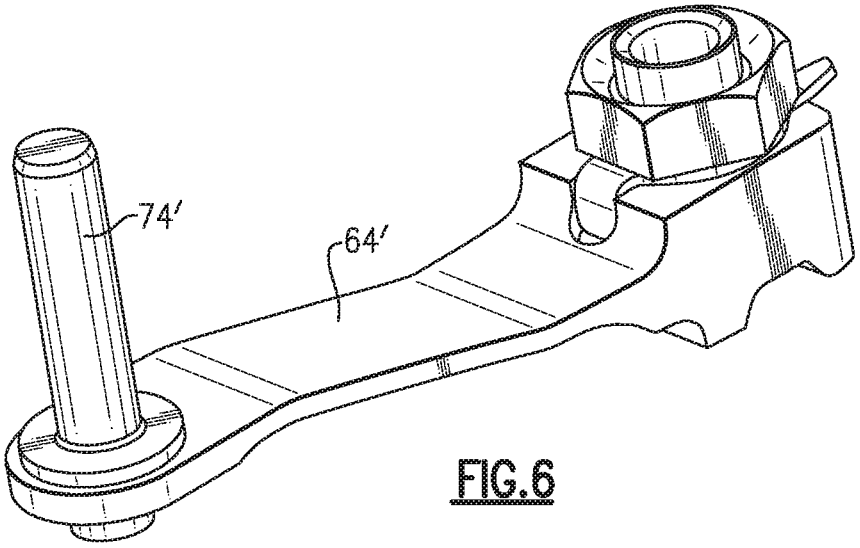
FIG. 6 illustrates another example configuration for attaching the system of FIG. 2 to the actuation ring of FIG. 4.
Figure 7:
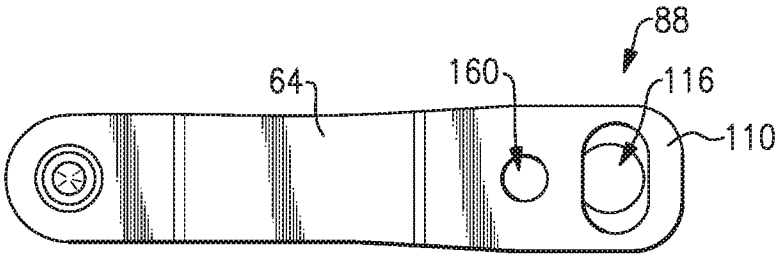
FIG. 7 illustrates a top view of a vane arm of the system of FIG. 2.
Figure 10:
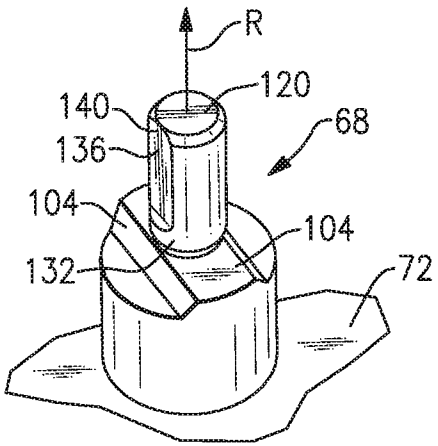
FIG. 10 illustrates a vane stem of the system of FIG. 2.
Figure 8:
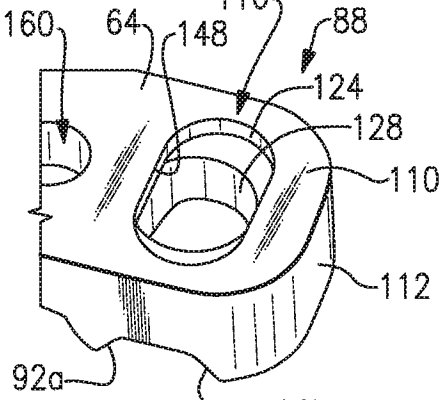
FIG. 8 illustrates a close-up view of an end of the vane arm of FIG. 7.
Figure 9:
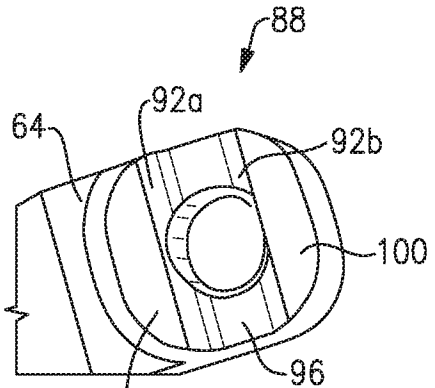
FIG. 9 illustrates a bottom view close-up perspective view of the end of the vane arm of FIG. 7.

Referring now FIGS. 5 and 6 with continuing reference to FIGS. 2-4, the pin 74 may be oriented relative to the vane arm 64 such that the pin 74 extends radially toward the axis A (FIG. 5). In other example, the pin 74' extends radially away from the axis A (FIG. 6). In the FIG. 5 configuration, the pin 74 is moved along the path $P_1$ radially toward the axis A to secure the pin 74 to the sync ring 66*a*. In the configuration of FIG. 6, the pin 74' is moved along the path $P_2$ radially outward away from the axis A to fit within a splice plate portion 66*b* of the acuation ring 66. Vane arms 64 and 64' have the same geometry and may be used for accommodating both types of installations.

Referring now to FIGS. 7-10 with continuing reference to FIGS. 2-4, an end 88 of the vane arm 64 includes features for easy assembly and ensuring a proper assembly to the vane stem 68. Notably, the example end 88 is secured to the vane stem 68 with a radial movement of the vane arm 64 along a radial axis R. Securing the vane arm 64 to the vane stem 68 helps to prevent the pin 74 from moving radially and backing out of an installed position within the bushing 86.

The disclosed vane arm 64 includes a first vane arm contact surface 92*a* and a second vane arm contact surface 92*b*. The vane arm contact surfaces 92*a* and 92*b* each extend between a first radially inward facing surface 96 and one of two second radially facing surfaces 100. The first radially facing surface 96 is radially stepped from the second radially facing surfaces 100 such that the first radially facing surface 96 is radially outward the second radially facing surfaces 100 when the vane arm 64 is installed over the vane stem 68.

The vane stem contact surfaces 92*a* and 92*b* are angled relative to the first and second radially facing surfaces 96 and 100. The vane stem contact surfaces 92*a* and 92*b* contact corresponding surfaces 104 of the vane stem to cause the vane stem 68 (and the associated vane 72) to rotate about the radially extending axis R.

The end 88 of the vane arm 64 further includes a radially outward facing surface 110. Side surfaces 112 of the end 88 extend radially to connect edges of the radially outward facing surface 110 to edges of the radially facing surfaces 96 and 110, and edges of the vane stem contact surfaces 92*a* and 92*b*. Notably, the vane stem contact surfaces 92*a* and 92*b* are angled relative to both the radially extending axis R and the radially outward facing surface 110.

The surfaces 92*a* and 92*b*, 96, 100, 110, and 112 of the end 88 are machined into the example vane arm 64. In one example, at least the vane stem contact surfaces 92*a* and 92*b* are machined using a milling operation.

The vane arm 64 may be formed out of nickel material. Machining this material permits the vane arm 64, and specifically the end 88, to be continuous radially between the first and second vane stem contact surfaces 92*a* and 92*b*, and the radially outward facing surface 100. Machining also facilitates providing the vane stem contact surfaces 92*a* and 92*b* as tapered surfaces.

In this example, the machined vane arms with tapered interfaces to facilitate accommodating relatively high surge loads, such as 30 K surge loads. In the prior art, the vane arm is typically sheet metal that is bent to establish a claw feature for engaging a vane stem. The claw feature of the bent sheet metal includes significant open areas at the end that engages the vane stem. The sheet metal designs, which utilize bending processes rather than machining, may be significantly weaker than the disclosed vane arm 64.

The end 88 of the vane arm 64 includes an aperture 116 that receives a threaded rod portion 120 of the vane stem 68. The aperture 116 includes a first axial section 124 and a second axial section 128. The first axial section 124 has a generally oval-shaped cross-sectional profile. The second axial section 128 has a generally circular-shaped cross-sectional profile. The second axial section 128 is received over a corresponding circular portion 132 of the vane stem 68.

A locating portion 136 of the vane stem 68 extends from the circular portion 132. The locating portion 136 is threaded and has a flat area 140 extending axially along the axis R and facing outward from the axis R. The flat area 140 contacts a corresponding flat side 148 of the first axial section 124 when the vane stem 68 is received within the aperture 116. Contact between the flat area 140 and the flat side 148 locates the vane arm 64 relative to the vane stem 68 providing an error proofing assembly aid. The "D" shape is, essentially, a mistaking-proofing feature to prevent misassembly.

The first axial section 124 and the second axial section 128 are machined into the end 88. The machining operations permit controlled material removal such that the first axial section 124 extends partially through a radial thickness of the vane arm 64 and the second axial section 128 extends radially partially through the end 88. Notably, EDM or non-conventional machining may not be required to create the aperture 116 having a "D" shaped feature and slot.

As appreciated from the Figures, the first axial section 124 is offset slightly from the second axial section 128 so that the flat side 148 may interface with the flat area 140 of the vane stem.

After the vane stem 68 is received through the aperture 116, a washer 152 is placed over the portion of the vane stem 68 that extends through the vane arm 64. The washer 152 includes a tab 156 that is received within a tab aperture 160 of the vane arm 64 to help locate the washer 152.

The tab 156 thus provides an orientation feature between the vane arm 64 and the washer 152. The washer 152 also provides for retention of the vane arm 64 to the vane stem 68.

A locking nut 164 is then threaded onto the vane stem 68 to hold the vane stem 68 in the vane arm 64 and the set orientation.

Features of the disclosed examples may include a vane stem attachment configuration that provides assembly mistake proofing features and a relatively stronger vane arm than prior art designs. Features of the example vane arms are machined into a piece of material. The vane stem includes corresponding machined features.

Although one or more example embodiments have been disclosed, a worker of ordinary skill in this art would recognize that certain modifications would come within the scope of this disclosure. For that reason, the following claims should be studied to determine the scope and content of this disclosure.

We claim:

1. A variable vane actuation system, comprising: a vane arm with at least one vane stem contact surface and a radially outward facing surface, the at least one vane stem contact surface to contact a vane stem of a variable vane and thereby actuate the variable vane about a radially extending axis, the at least one vane stem contact surface angled relative to both the radially extending axis and the radially outward facing surface; an aperture extending through the radially outward facing surface to receive the vane stem, at least a portion of the aperture having a non-circular cross-sectional profile; and the vane arm includes at least one first radially inward facing surface and at least one second radially inward facing surface, the at least one vane stem contact surface abuts the at least one first radially inward facing surface and the at least one second radially inward facing surface.

2. The system of claim 1, wherein the aperture comprises a first axial section and a second axial section, the first axial section having a oval-shaped cross sectional profile, the second axial section having a circular-shaped cross-sectional profile.

3. The system of claim 2, including a tab aperture extending through the vane arm for accepting a tab on a washer.

4. The system of claim 1, wherein the at least one vane stem contact surface comprises a first vane stem contact surface and a second vane stem contact surface, the aperture positioned between the first and second vane stem contact surfaces.

5. The system of claim 1, wherein the at least one vane stem contact surface is a machined surface.

6. The system of claim 5, wherein the at least one vane stem contact surface is a milled surface.

7. The system of claim 1, wherein the vane arm is continuous radially between the at least one vane stem contact surface and the radially outward facing surface.

8. The system of claim 1, wherein the vane arm completely fills an area extending radially from the at least one vane stem contact surface to the radially outward facing surface.

9. The system of claim 1, wherein the first and second radially inward facing surfaces are radially stepped from each other.

10. The system of claim 1, wherein the vane arm is configured to be received radially over the vane stem.

11. A variable vane actuation system for a gas turbine engine comprising; a variable vane assembly including a vane arm attached to a vane stem and arranged to rotate the vane stem about a radial axis, the vane arm having a machined surface to contact and rotate the vane stem; a tab aperture extending through the vane arm for accepting a tab on a washer; and the vane arm includes at least one first radially inward facing surface abuts the at least one second radially inward facing surface by at least one vane stem contact surface.

12. The variable vane actuation system of claim 11, wherein the vane arm includes a D-shaped opening corresponding with a D-shaped portion of the vane stem.

13. The variable vane actuation system of claim 12, wherein the washer surrounds the vane stem.

14. The variable vane actuation system of claim 13, including: an aperture extending through a radially outward facing surface of the vane arm to receive the vane stem, a least a portion of the aperture having a non-circular cross-sectional profile, wherein the at least one vane stem contact surface actuates the variable vane about a radially extending axis, the at least one vane stem contact surface angled relative to both the radially extending axis and the radially outward facing surface.

15. A vane arm manufacturing method, comprising: machining at least one vane stem contact surface into a piece of material when providing a vane arm, the vane stem contact surface to contact a vane stem to actuate a variable vane, wherein an area extending radially from the at least one vane stem contact surface to an outwardly facing surface of the vane arm is completely filled with a material and the vane arm includes at least one first radially inward facing surface abutting at least one second radially inward facing surface by the vane stem contact surface; and establishing an aperture extending through the radially outward facing surface to receive the vane stem, a least a portion of the aperture having a non-circular cross-sectional profile, wherein the aperture comprises a first axial section and a second axial section, the first axial section having an oval-shaped cross sectional profile and the second axial section having a circular-shaped cross-sectional profile.

16. The vane arm manufacturing method of claim 15, wherein the at least one vane stem contact surface comprises a first vane stem contact surface and a second vane stem contact surface, the aperture positioned between the first and second vane stem contact surfaces.

17. The vane arm manufacturing method of claim 16, including a tab aperture extending through the vane arm for accepting a tab on a washer.

18. The vane arm manufacturing method of claim 15, wherein the at least one vane stem contact surface is angled relative to both a radially extending axis and the radially outward facing surface.

* * * * *